US006793317B2

(12) United States Patent
Shima

(10) Patent No.: US 6,793,317 B2
(45) Date of Patent: Sep. 21, 2004

(54) INKJET RECORDING APPARATUS AND CAP FOR RECORDING HEAD

(75) Inventor: Takeaki Shima, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 30 days.

(21) Appl. No.: 10/128,468

(22) Filed: Apr. 24, 2002

(65) Prior Publication Data

US 2002/0158939 A1 Oct. 31, 2002

(30) Foreign Application Priority Data

Apr. 27, 2001 (JP) ..... 2001-133033

(51) Int. Cl.[7] ..... B41J 2/165
(52) U.S. Cl. ..... 347/29; 347/30
(58) Field of Search ..... 347/29, 30, 22, 347/28, 31, 32, 23

(56) References Cited

U.S. PATENT DOCUMENTS 6,471,329 B1 * 10/2002 Maza ..... 347/29
6,491,370 B2 * 12/2002 Momose ..... 347/30

FOREIGN PATENT DOCUMENTS

JP 2000-052567 * 2/2000

* cited by examiner

*Primary Examiner*—Shih-wen Hsieh
(74) *Attorney, Agent, or Firm*—Fitzpatrick, Cella, Harper & Scinto

(57) ABSTRACT

A cap for a recording head capable of covering a nozzle of the recording head in a securely enclosed state during sucking of ink is provided for an inkjet recording apparatus. The cap for the recording head includes an elastically deformable contact section and an abutting section. When a nozzle-forming surface of the recording head is pressed into contact with the contact section so that the contact section deforms to have a predetermined amount of deformation, the abutting section abuts against the nozzle-forming surface so as to restrict the deformation of the contact section. Therefore, the contact section cannot deform excessively, enabling to properly maintain the close contact to the nozzle-forming surface and preventing ink from being dried and increased in viscosity.

4 Claims, 5 Drawing Sheets

INKJET RECORDING APPARATUS AND CAP FOR RECORDING HEAD

BACKGROUND OF THE INVENTION

1. Field of the Invention

The present invention relates to an inkjet recording apparatus having a recording head including an ink-ejecting nozzle (an ejecting opening) and a cap for the recording head covering the recording head.

2. Description of the Related Art

In general, in an inkjet recording apparatus, a foreign material such as paper dust and dirt may be stuck to a nozzle of a recording head, or ink within the nozzle may be dried to increase in viscosity or to adhere to the nozzle, so that the nozzle may be clogged so as to have imperfect ejection (including non-ejection). Then, in order to prevent such clogging, a recovery mechanism has been used, in which in a non-recording mode, the nozzle is covered with a cap tightly while ink is sucked from the nozzle via the cap by sucking means such as a pump, so that the nozzle is normalized.

In an inkjet recording apparatus for recording by reciprocating a recording head mounted on a carriage, it is required to increase the capacity of an ink tank in order to reduce the replacement frequency of the ink tank. By the way, in an inkjet recording apparatus having a recording head formed integrally with an ink tank, when the capacity of the ink tank is increased, there is a problem that the inertia force of the recording head and the ink tank moving with the carriage is increased so that vibration and noise due to reciprocation scanning are liable to be produced. Therefore, an inkjet recording apparatus employing a so-called tube-feed system is also known, in which an ink tank (main tank) is fixed at a predetermined position in an apparatus body, and a sub-tank moving with the recording head on the carriage is connected to the main tank with a tube, etc.

In the inkjet recording apparatus, it is usually the case that in an other than recording mode, a very small negative pressure relative to atmospheric pressure is always applied thereto so as not to drop recording ink. This is for preventing unnecessary ink dropping in the non-recording mode, whereas in the inkjet recording apparatus employing the tube-feed system, along with drifting of the recording ink within the connecting tube due to the reciprocation scanning of the carriage, the ink within the sub-tank may be pushed out or drawn back so that the discharge amount fluctuates, resulting in recording unevenness or non-ejection.

As a measure to meet this problem, a technique employing an air-cushion container is known, in which an air reservoir is arranged in the vicinity of the recording head between the tube and the recording head so as to buffer pressure fluctuation due to ink drifting within the tube utilizing elasticity of air for stabilizing the ink discharge amount. The air-cushion container also serves to isolate air from the ink in the tube having air mixed therewith so as to supply only ink to the recording head by arranging an upper part of the container for the air reservoir and a lower part for an ink reservoir.

According to this configuration, a necessary liquid level of the ink reservoir needs to be maintained so as not to mix air from the air reservoir into the recording head. In order to prevent to mix air into the recording head, there is a system, in which recording is performed by transferring a recording medium without scanning the carriage; however, a similar container may be necessary for separating mixed air also in this case, so that the necessary liquid level of the ink reservoir formed inside needs to be maintained. The liquid level of the ink reservoir tends to decrease gradually due to permeation of air through a tube wall thereinto and deaeration of dissolved air in ink, so that means for maintaining the necessary liquid level is required.

In an inkjet recording apparatus, in which ink is supplied to the sub-tank from the main tank with one ink-feeding tube, a method for maintaining the necessary liquid level is proposed and performed, in which opening-and-closing means is arranged in an ink-passage while using sucking means of a recovery mechanism for the recording head. That is, in this system, after shutting off between the main tank and the sub-tank by closing the opening-and-closing means, ink in the recording head is sucked by the sucking means so as to generate a negative pressure in the recording head for controlling a vacuum in the air-cushion container. Then, the main tank is communicated with the sub-tank by opening the opening-and-closing means so as to restore the necessary liquid level.

However, in the inkjet recording apparatus described above, since when the interior of the air-cushion container is reduced in pressure, a large negative pressure is generated due to a cap, a cap rib is excessively deformed due to an elastic member so as to come closely in contact with the recording head, so that sealing of the recording head may be damaged so as not to obtain a sufficient vacuum.

Also, in a color printer using multicolor ink, discharge openings of the recording head may come in contact with an ink absorber within the cap of the recording head so that color ink of the recording head of each color is mixed with the other so as to generate a color mixture, resulting in extremely damaged recording quality.

SUMMARY OF THE INVENTION

It is an object of the present invention to provide a cap for a recording head capable of covering a nozzle of the recording head in a securely enclosed state during sucking of ink by a recovery mechanism, and to provide an inkjet recording apparatus using the cap for the recording head.

In accordance with a first aspect of the present invention, an inkjet recording apparatus comprises a recording head including a nozzle for ejecting ink formed on a nozzle-forming surface opposing a recording medium, and a cap for the recording head, which can be brought into and out of contact with the nozzle-forming surface and which covers the nozzle when abutting against the nozzle-forming surface. Further the cap for the recording head comprises an elastically deformable contact section for forming an enclosed space for covering the nozzle by being pressed into contact with the nozzle-forming surface, and an abutting section for abutting against the nozzle-forming surface of the recording head so as to restrict the amount of deformation of the contact section when the contact section is elastically deformed to have a predetermined amount of deformation by being pressed into contact with the nozzle-forming surface. Furthermore, the contact section and the abutting section are formed of a same member.

In accordance with a second aspect of the present invention, a cap for a recording head, which can be brought into and out of contact with a nozzle-forming surface arranged in an inkjet recording apparatus and which covers a nozzle when abutting against the nozzle-forming surface, the cap comprises an elastically deformable contact section for forming an enclosed space for covering the nozzle by being pressed into contact with the nozzle-forming surface, and an abutting section for abutting against the nozzle-forming surface of the recording head so as to restrict the amount of deformation of the contact section when the contact section is pressed into contact with the nozzle-forming surface to elastically deform to have a predetermined amount of deformation.

According to the present invention, when the nozzle-forming surface of the recording head is pressed in contact with the contact section under comparatively high pressure so that the contact section deforms to have a predetermined amount of deformation, the abutting section abuts against the nozzle-forming surface at that time so as to restrict the deformation of the contact section. Therefore, the contact section cannot deform excessively, enabling to properly maintain the close contact state to the nozzle-forming surface of the recording head and preventing ink from being dried and increased in viscosity. Also, even when a large negative pressure is generated within the cap during sucking of ink, excessive deformation of the contact section can be prevented by the abutment between the abutting section and the recording head. Moreover, since the abutting section and the contact section are formed of the same member, a clearance between the both sections cannot be generated during elastic deformation different from the case of being formed of different members, so that high-accuracy sealing can be obtained. Therefore, proper sucking by the cap is enabled so that recovery of the nozzle of the recording head or adjustment of the liquid level of the ink reservoir can be securely performed, resulting in improving reliability of the inkjet recording apparatus. Also, excessive deformation of a cap rib can be prevented due to the abutment between a stopper and the recording head, so that an ink absorber within the cap can be prevented from coming in contact with a discharge opening, thereby preventing a color mixture even in a multicolor printer.

Further objects, features and advantages of the present invention will become apparent from the following description of the preferred embodiments with reference to the attached drawings.

DESCRIPTION OF THE PREFERRED EMBODIMENTS

An inkjet recording apparatus according to an embodiment of the present invention will be specifically described below with reference to the drawings.

Figure 1:
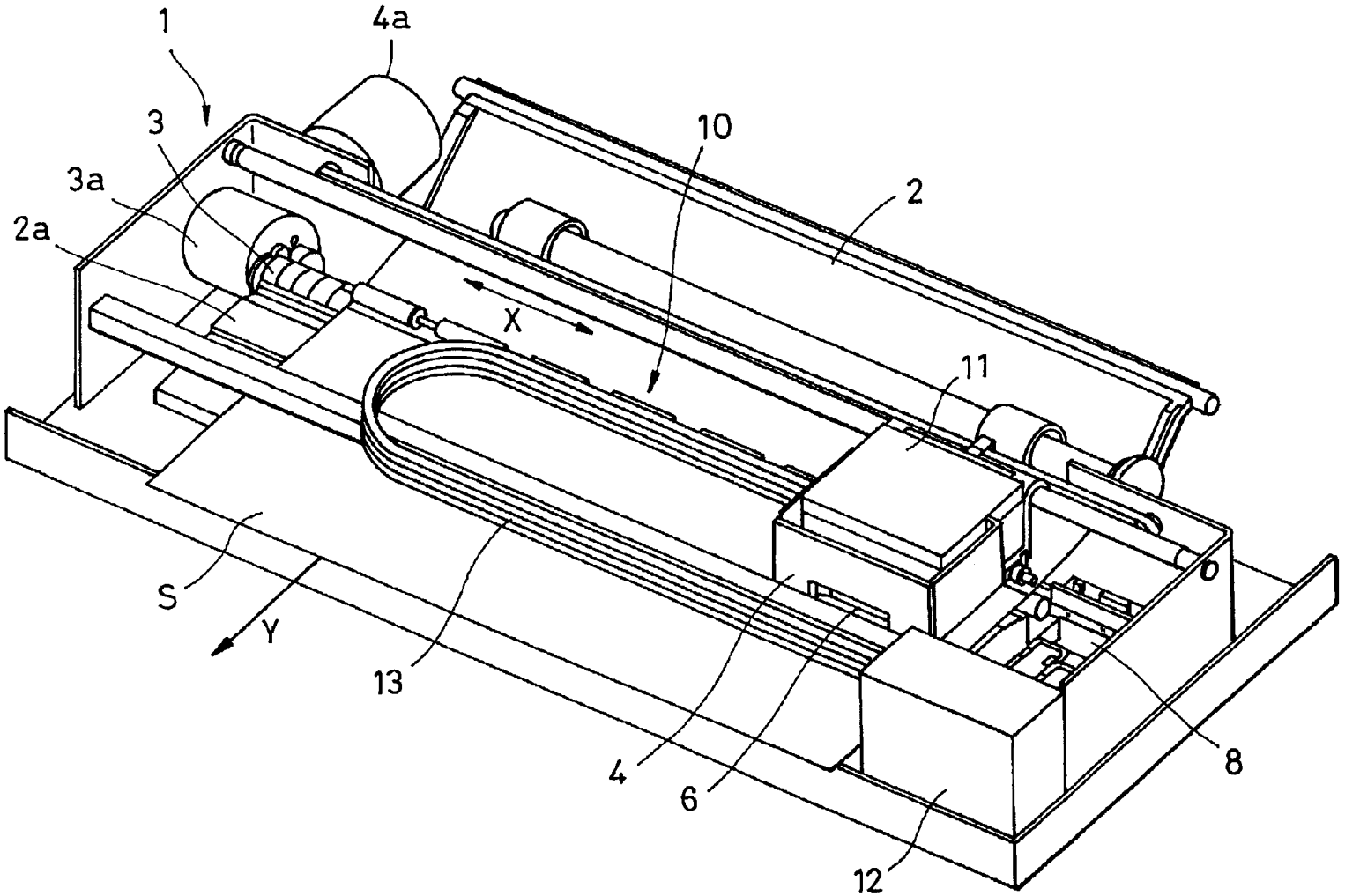
FIG. 1 is a schematic configuration diagram of an entire apparatus body of an inkjet recording apparatus according to an embodiment of the present invention.

FIG. 1 shows a schematic configuration of an apparatus body 1 of the inkjet recording apparatus according to the present invention, and the apparatus body 1 is configured as follows.

Referring to FIG. 1, a recording sheet introduced from a paper-feed section 2 arranged in the rear of the apparatus body 1 is fed toward the front of the apparatus body 1 via a recording position having a platen 2*a* arranged therein by a recording-medium-transfer mechanism 3 driven by a feeding motor (an LF motor) 3*a*. Within the apparatus body 1, there is provided a carriage 4, which reciprocates in a direction (the main-scanning direction (X-direction)) perpendicular to the recording-medium transfer direction (the sub-scanning direction (Y-direction)) by the recording-medium-transfer mechanism 3, and is driven by a carriage motor (a CR motor) 4*a*.

The carriage 4 is provided with an inkjet recording head (referred to simply as a recording head below) 6 for recording on a recording sheet 1 and a sub-tank 11 for containing ink for supplying to the recording head 6, which are integrally mounted thereon. In addition, the recording head 6 according to the embodiment is configured such that ink is ejected as an ink-droplet from a nozzle 6*a* formed on a nozzle-forming surface 6*b* by applying a signal corresponding to recording data to a piezoelectric element, heating element, or the like, as shown in FIG. 3.

Figure 3:
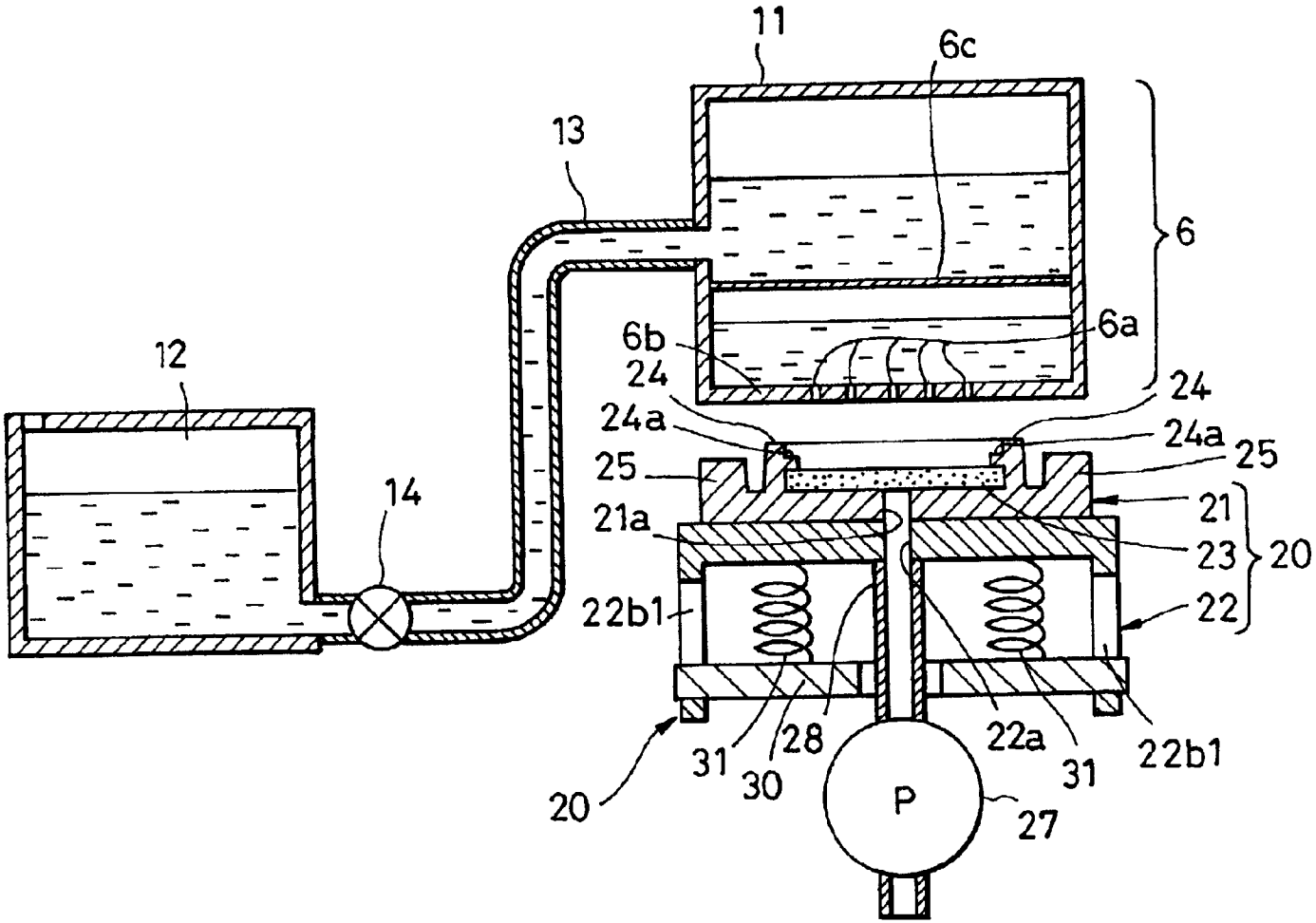
FIG. 3 is a longitudinal sectional side view of the cap in an open state showing the relationship between a recording head, an ink-supply mechanism, and the cap for the recording head according to the embodiment of the present invention.

As shown in FIG. 3, within the recording head 6, there is attached a filter 6*c* for preventing foreign materials from entering so as not to clog up the nozzle 6*a*, and spaces in upper and lower parts of the filter 6*c* are respectively formed of an ink blanket and air blanket.

On the other hand, the apparatus body 1 is also provided with a recovery mechanism 8 for preventing an ink agent from evaporating from the nozzle 6*a* formed on the nozzle-forming surface 6*b* in a non-recording mode and also for correcting an ejecting state of ink from the nozzle 6*a* and an ink-feeding mechanism 10 for supplying ink to the sub-tank 11.

The ink-feeding mechanism 10, as shown in FIGS. 1 and 3, comprises the sub-tank 11, a main tank 12 for replenishing the sub-tank 11 with ink, an ink-feeding tube 13 for connecting between the main tank 12 and the sub-tank 11 as an ink-supplying passage, and a valve 14 for communicating and shutting off the ink-feeding tube, so as to have a so-called tube-feed system. The main tank 12 is placed so as to have a predetermined water head relative to the recording head 8 so that recording ink does not drop in other than the recording mode, and it can be supplied into the recording head 8 through the ink-feeding tube 13.

Figure 2:
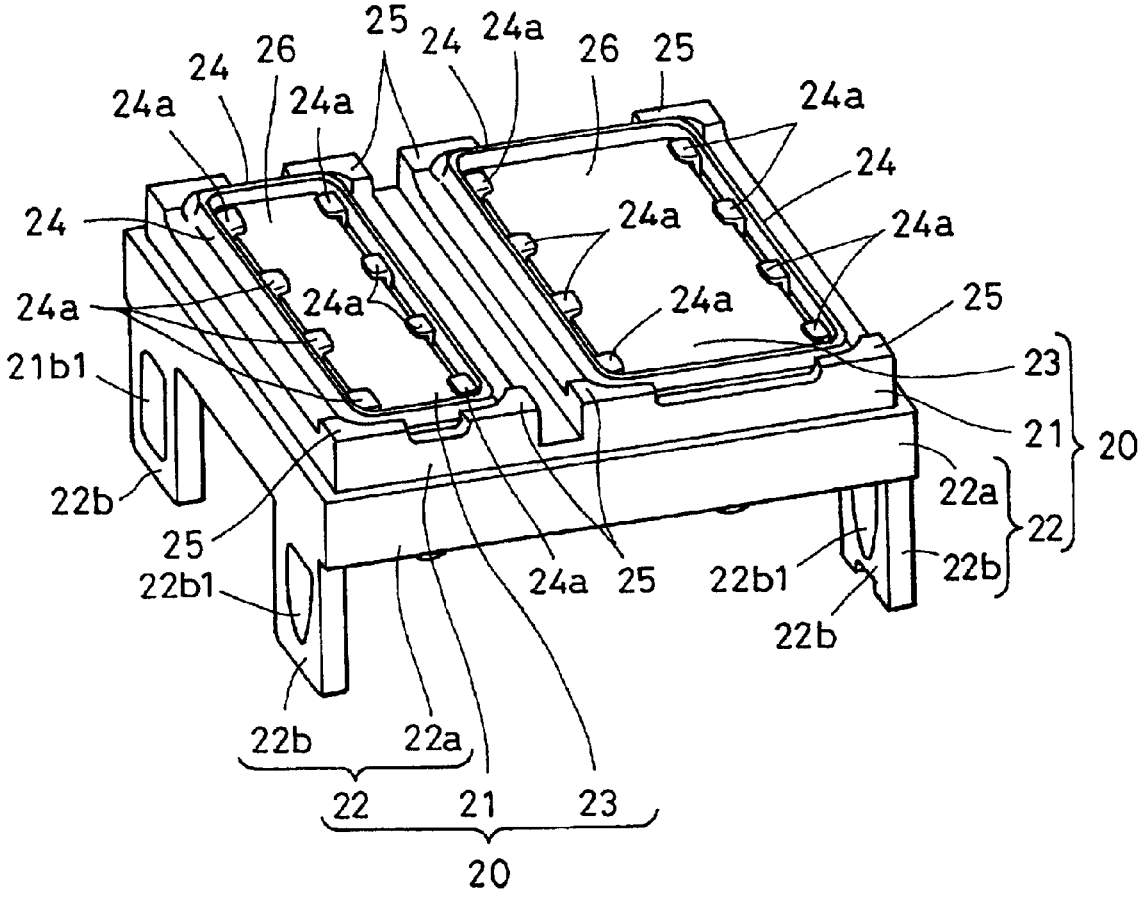
FIG. 2 is a perspective view of a cap for a recording head applied in the inkjet recording apparatus according to the embodiment of the present invention.
Figure 4:
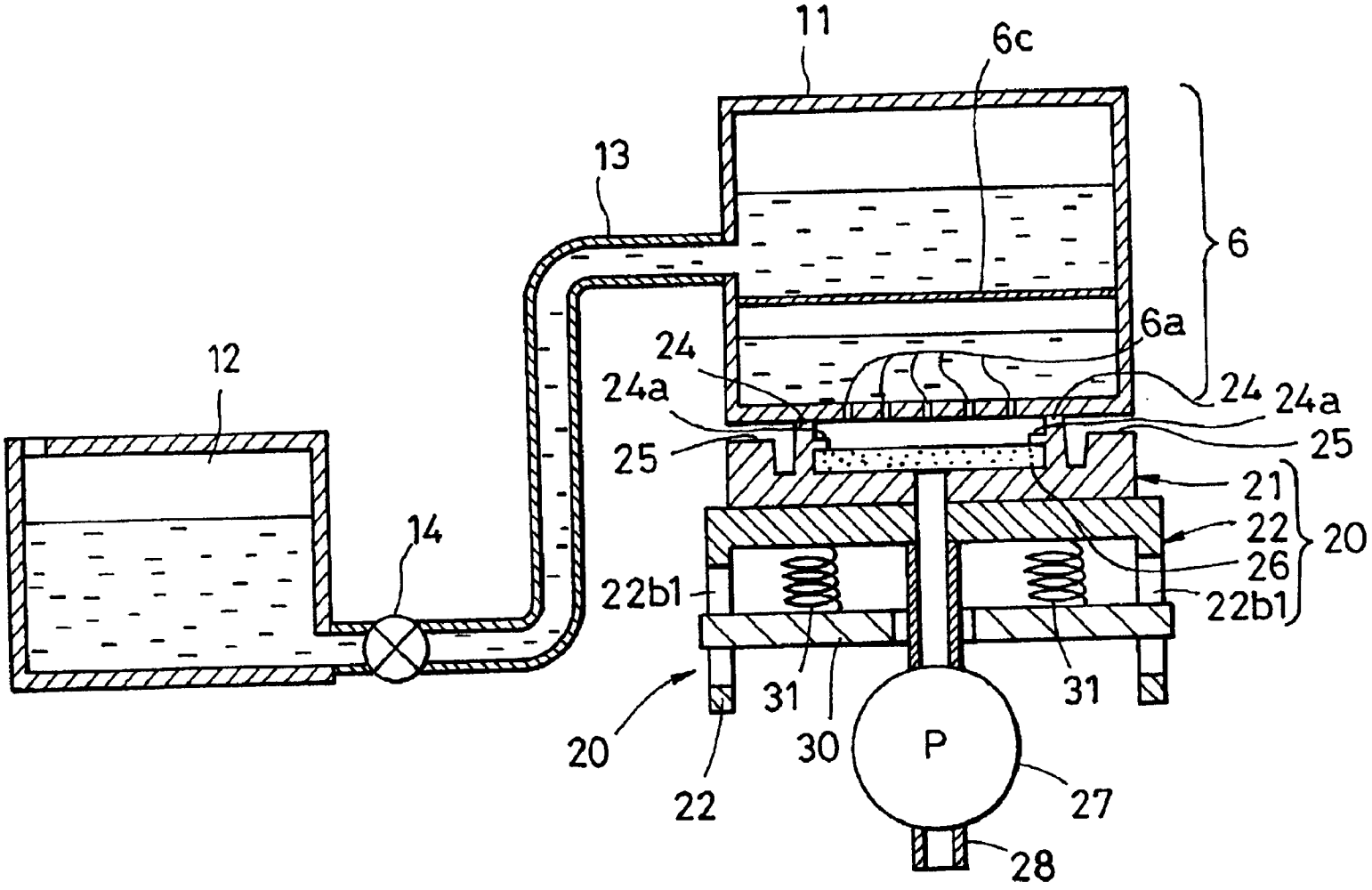
FIG. 4 is a longitudinal sectional side view of the cap in a closed state showing the relationship between the recording head, the ink-supply mechanism, and the cap for the recording head according to the embodiment of the present invention.
Figure 5:
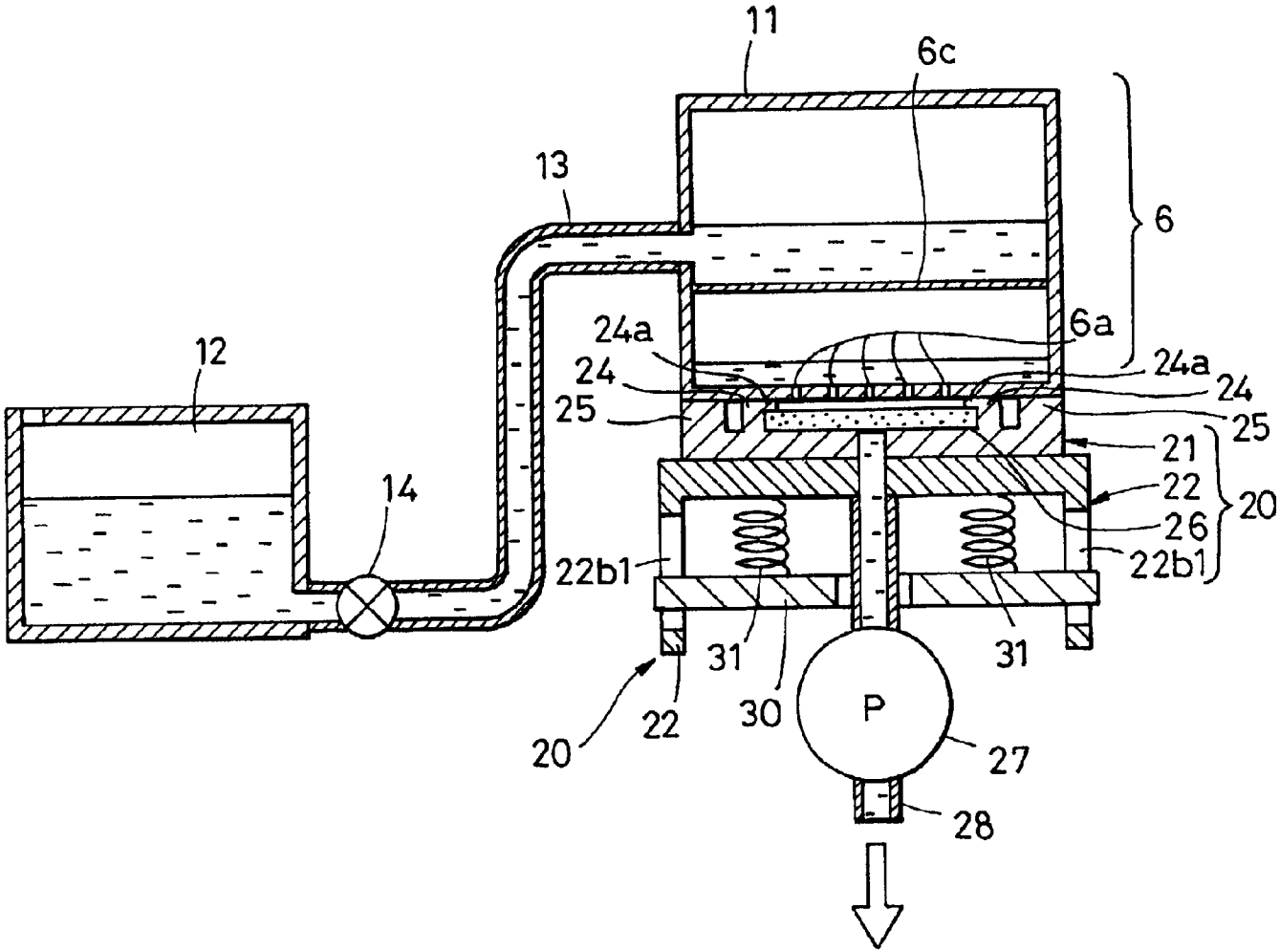
FIG. 5 is a longitudinal sectional side view of the recording head during adjustment of a liquid level of an ink peddle inside the recording head showing the relationship between the recording head, the ink-supply mechanism, and the cap for the recording head according to the embodiment of the present invention.

Next, referring to FIGS. 2 to 5, a cap for the recording head used in the recovery mechanism will be described. FIG. 2 is a perspective view of a cap 20 for the recording head according to the embodiment; FIGS. 3 to 5 are representational longitudinal-sectional side elevations for conceptionally showing the relationship between the recording head 6, the ink-feeding mechanism 10, and the cap for the recording head 20.

Referring to FIG. 2, the cap 20 for the recording head according to the embodiment comprises a cap section 21, a base section 22 fixed on the bottom surface of the cap section 21, and ink absorbers 23 fixed to the cap section 21. The cap section 21 is made of an elastic material such as a rubber and elastomer, and two rectangular ribs (contact sections) 24 upward raised from the bottom are formed within the cap section 21. Within the two rectangular ribs 24, the ink absorbers 23 are inserted, which are supported on the bottom of the cap sections 21 while being prevented from upward coming off with claws 24*a*, which protrude inward from internal side-faces of the ribs 24. In addition, the ink absorber 23 is made of a porous material so that ink supplied in the cap section 21 can be efficiently discharged to a discharge passage, which will be described later.

In the cap section 21, there are provided four stoppers (abutting section) 25 formed on the exterior of each rib 24 and opposing the corner of each rib 24. The stopper 25, as shown in FIG. 3, has a thickness larger than that of the rib 24, so that the stopper 25 has stiffness higher than that of the rib 24 so as to have a small amount of deformation against a downward pressing force. The upper end of the rib 24 is prominent upper than the upper surface of the stopper 25, and the upper surface of the stopper 25 is positioned higher than the upper surface of the ink absorber 23 fixed into the ribs 24. Accordingly, after the rib 24 is pressed in contact on the nozzle-forming surface 6*b* of the recording head 6 so as to have a predetermined deformation, the stoppers 25 abut the recording head 6. Also, the rib 24 and stoppers 25, as shown in FIG. 2, are arranged so as to be able to oppose the nozzle-forming surface 6*b* of the recording head 6 substantially in parallel therewith, and the rib 24 is formed within a range that the nozzle-forming surface 6*b* can be surrounded.

On the other hand, the base section 22 is provided with a rectangular supporting part 22*a* for supporting the bottom of the cap section 21 and four leg parts 22*b* disposed at four corners of the supporting part 22*a*. The cap section 21 is elastically supported by a cap holder 30, which moves up-and-down via springs 31 by a predetermined elevating mechanism (moving means). Both lateral sides of the cap holder 30 are inserted into slotted holes 22*b*1 formed in the leg parts 22*b* of the base section 22. Therefore, the cap holder 30 and the base section 22 are relatively movable within the range of the length of the slotted hole 22*b*1, so that the bottom surface of the cap holder 30 is always urged in contact with lower ends of the slotted holes 22*b*1 due to the urging force of the springs 31.

In the inkjet recording apparatus configured as above, in the recording mode, the cap holder 30 is located at the lowest position in the recovery mechanism 8 so that the cap section 21 of the cap holder 30 is maintained at a position (cap-open position) separated downward from the nozzle-forming surface 6*b* of the recording head 6, as shown in FIG. 3. Therefore, the recording head 6 can be moved without interference with the head cap 20.

Since the recording head 6 performs recording operation by ejecting ink from the nozzle 6*a* as ink droplets, the ink contained in the recording head 6 gradually decreases along with the recording operation so as to generate a negative pressure in the recording head 6. The valve 14 arranged in the ink-feeding tube 13 is open at this time, so that the ink contained in the main tank 12 flows into the recording head 6 via the ink-feeding tube 13 due to the negative pressure in the recording head 6 so as to replenish the recording head 6 until the amount before the recording operation.

In the non-recording mode, recovery operation in the nozzle 6*a* of the recording head 6 is performed by the recovery mechanism 8. In the recovery operation, the cap holder 30 is first elevated by an elevating mechanism (moving means, not shown) and the cap for the recording head 20 is also moved upward via the springs 31. Thereby, the rib 24, which protrudes upward to the utmost in the cap section 21, abuts the nozzle-forming surface 6*b* of the recording head 6 and then the rib 24 is stuck on the nozzle-forming surface 6*b* of the recording head 6 while correcting micro angular discrepancies with the recording head 8 by further moving the cap holder 30 upward. As a result, the nozzle 6*a* is covered with the rib 24 so as to form an enclosed space between the rib 24 and the nozzle-forming surface 6*b* for isolating the external atmosphere.

Then, when driving a pump 27 while opening the valve 14, a negative pressure is generated in the enclosed space within the rib 24 via an ink discharge pipe 28 and the ink absorber 23, and ink with increased viscosity and the like are sucked from the nozzle 6*a* by the negative pressure so that the ink is discharged via the ink discharge pipe 28 after being absorbed into the ink absorber 23. The ink within the nozzle is thereby normalized. Also, in the stand-by mode, increase in viscosity or sticking of ink in the nozzle 6*a* can be prevented by closing the valve 14 without driving the pump 27.

On the other hand, FIG. 4 is a schematic longitudinal-sectional-side view for conceptionally illustrating the relationship between the recording head 6, the ink-feeding mechanism 10, and the cap for the recording head 20 when controlling the liquid level of an ink reservoir within the recording head 6.

The liquid level control is performed such that the valve 14 is closed and the pump 27 is driven from the state shown in FIG. 3. Accordingly, the ink within the recording head 6 is sucked by the pump 27 while ink is not supplied thereto from the main tank 12, so that the recording head 6 and the enclosed space within the rib 24 are reduced in pressure and the rib 24 is deformed inwardly. However, when the rib 24 deforms by a predetermined amount and the cap section 21 approaches the nozzle-forming surface 6*b*, as shown in FIG. 4, the stoppers 25 abut the nozzle-forming surface 6*b* of the recording head 6. Since the stopper 25 is formed larger in thickness than the rib 24, the stopper 25 scarcely deforms in the vertical direction even when abutting the nozzle-forming surface 6*b*. Therefore, after the stoppers 25 abut the nozzle-forming surface 6*b*, the deformation of the rib 24 is restricted so as to eliminate excessive deformation. As a result, the close contact state between the rib 24 and the nozzle-forming surface 6*b* is properly maintained, resulting in sufficient achievement of the function as a cap.

Also, with restricting deformation of the rib 24 by the stoppers 25, a space between the ink absorber 23 and the nozzle 6*a* is maintained so that the both cannot come in contact with each other directly, thereby eliminating a color mixture caused by contact of different colors to the nozzle 6*a*.

Also, after the interior of the recording head 6 is reduced in pressure at a predetermined value, the liquid level of the ink reservoir can be restored to an initial value by opening the valve 14.

(Other Embodiments)

According to the embodiment described above, as a method for maintaining the required liquid level in the recording head 6, a case has been exemplified, in which opening-and-closing means (the valve 14) is arranged in the ink-passage and the ink in the recording head 6 is sucked by sucking means (the pump 27) of the recovery mechanism in the closed state of the opening-and-closing means so as to generate a negative pressure in the recording head 6. However, the present invention is not limited to the embodiment and the interior of the recording head may be reduced in pressure by forming a narrow ink passage to have a head loss in the ink passage.

Furthermore, also as for the ink tank, the present invention is not limited to the tank formed integrally with the recording head; however, the present invention may be applied to an inkjet recording apparatus having a so-called ink cartridge being detachable to and from the recording head.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An inkjet recording apparatus for discharging ink from a nozzle of a recording head, comprising:

a cap for the recording head, which can be brought into and out of contact with a nozzle-forming surface and which covers the nozzle when abutting against the nozzle-forming surface, the cap comprising:

an elastically deformable contact section for forming an enclosed space for covering the nozzle by being pressed into contact with the nozzle-forming surface; and a stopper for restricting an amount of deformation of the contact section by being pressed into contact with a position outside of a position where the contact section is pressed into contact with the nozzle-forming surface, so that the contact section is elastically deformable to a predetermined amount;

moving means for bringing the cap for the recording head into and out of contact with the recording head; and absorbing means for communicating with the contact section and also for generating a negative pressure in the enclosed space, wherein when the contact section abuts against the nozzle-forming surface of the recording head by the moving means, the stopper does not abut against the nozzle-forming surface, whereas when a negative pressure with at least a predetermined value is generated in the enclosed space by the absorbing means, the stopper abuts against the nozzle-forming surface of the recording head together with the contact section.

2. An apparatus according to claim 1, wherein the stopper has high stiffness, so that the stopper is less deformable than the contact section.

3. An apparatus according to claim 1, wherein the cap for the recording head has an ink absorber accommodated within the contact section, and wherein when the contact section is pressed into contact with the nozzle-forming surface, the stopper restricts elastic deformation of the contact section so as to form a clearance between the ink absorber and the recording head.

4. An inkjet recording apparatus according to claim 1, wherein the contact section and the stopper are formed of a same member.

* * * * *